US005634423A

United States Patent [19]

Lashman

[11] Patent Number: 5,634,423

[45] Date of Patent: Jun. 3, 1997

[54] PERSONAL SUBMERSIBLE MARINE VEHICLE

[76] Inventor: Morton E. Lashman, 631 SW. 44th Ave., Plantation, Fla. 33317

[21] Appl. No.: 582,105

[22] Filed: Jan. 2, 1996

[51] Int. Cl.[6] ..... B63C 11/46

[52] U.S. Cl. ..... 114/315; 440/6

[58] Field of Search ..... 114/343, 315, 114/362; 440/6; D12/308

[56] References Cited

U.S. PATENT DOCUMENTS

| | | | |
|---|---|---|---|
| 2,722,021 | 11/1955 | Keogh-Dwyer | 114/315 |
| 3,014,448 | 12/1961 | Fogarty et al. | 114/315 |
| 3,442,240 | 5/1969 | Wild et al. | 114/315 |
| 4,864,959 | 9/1989 | Takamizawa et al. | 114/315 |
| 5,303,666 | 4/1994 | DeSantis et al. | 440/6 |

*Primary Examiner*—Edwin L. Swinehart
*Attorney, Agent, or Firm*—Joseph Zallen

[57] ABSTRACT

An improved, personal, submersible marine vehicle with a fluid-tight elongated hull having an open back and a removable cover. Within the hull is a battery compartment. A shrouded propeller and motor depend from the hull. A dense, rigid cellular foam section fills substantially all of the air space in the hull and surrounds the battery compartment. Electrical speed control means for the motor are embedded in the foam section so that the battery is shielded from contact with any source of spark in the electrical control means. Further, the foam section provides a substantially greater effective hull thickness than the actual thickness of the hull so that the vehicle can be safely used at far greater depths. Also, the foam section renders the vehicle substantially leak-proof.

6 Claims, 3 Drawing Sheets

PERSONAL SUBMERSIBLE MARINE VEHICLE

BACKGROUND OF INVENTION

The invention relates to an improvement in the field of personal submersible marine vehicles. In particular, it relates to a personal, submersible, marine vehicle which is explosion proof, can be safely operated by a diver at depths over 300 feet, and is substantially leak-proof.

Many attempts have been made in the prior art to provide a swimmer or diver with a small propulsion vehicle which will enable him or her to move rapidly on or below the surface of water. Such vehicles typically have a buoyant chamber and a battery-operated motor which drives a propeller. Such devices are preferably small and light in weight so that the user can take them from place to place with ease.

The various designs that have been tried in the past have a number of deficiencies. One is that they are too heavy or awkward to handle. Another is that they often leak water. Yet another problem is the generation of inflammable gas from the battery has in some cases unfortunately caused explosions from sparks. Still another limitation on the use of such personal submersible marine vehicles is that they often implode at depths slightly greater than 100 feet.

The present inventor has developed personal, submersible, marine vehicles which overcome most of these problems. His U.S. Pat. Nos. 5,423,278 and 5,303,666, describe such vehicles which have a elongated, water-tight buoyant hull, below which is positioned a shroud enclosing a motor and propeller. The hull contains a battery which is connected to the motor, accessible power and speed switches, and gripping means.

In accordance with the present invention, the applicant has improved on the concept of his prior patents to provide a vehicle which is essentially explosion proof, can be safely used at depths of over 300 feet, and is substantially leak-proof.

Further objects and advantages of this invention will be apparent from the description and claims which follow, taken together with the appended drawings.

SUMMARY OF INVENTION

The improved, personal, submersible marine vehicle of this invention comprises a fluid-tight elongated hull having an open back and a removable cover. Within the hull is a battery compartment in which a battery is mounted and which is accessible from the back of the vehicle. A shrodded propeller and motor depend from the hull. A dense, rigid cellular foam section fills substantially all of the air space in the hull and surrounds the battery compartment. Electrical speed control means for the motor are embedded in the foam section so that the battery is shielded from contact with any source of spark in the electrical control means, thus preventing explosions. Further, the foam section provides a substantially greater effective hull thickness than the actual thickness of the hull so that the vehicle can be safely used at far greater depths. Also, the foam section renders the vehicle substantially leak-proof. Accessible speed control is provided by an external handle or handles which control a magnetic switch or switches to actuate the electrical speed control means. The speed control means can be separate, as for example a high-speed unit and a low-speed unit, or can be a single unit containing several speeds.

SPECIFIC EXAMPLE OF INVENTION

Figure 1:
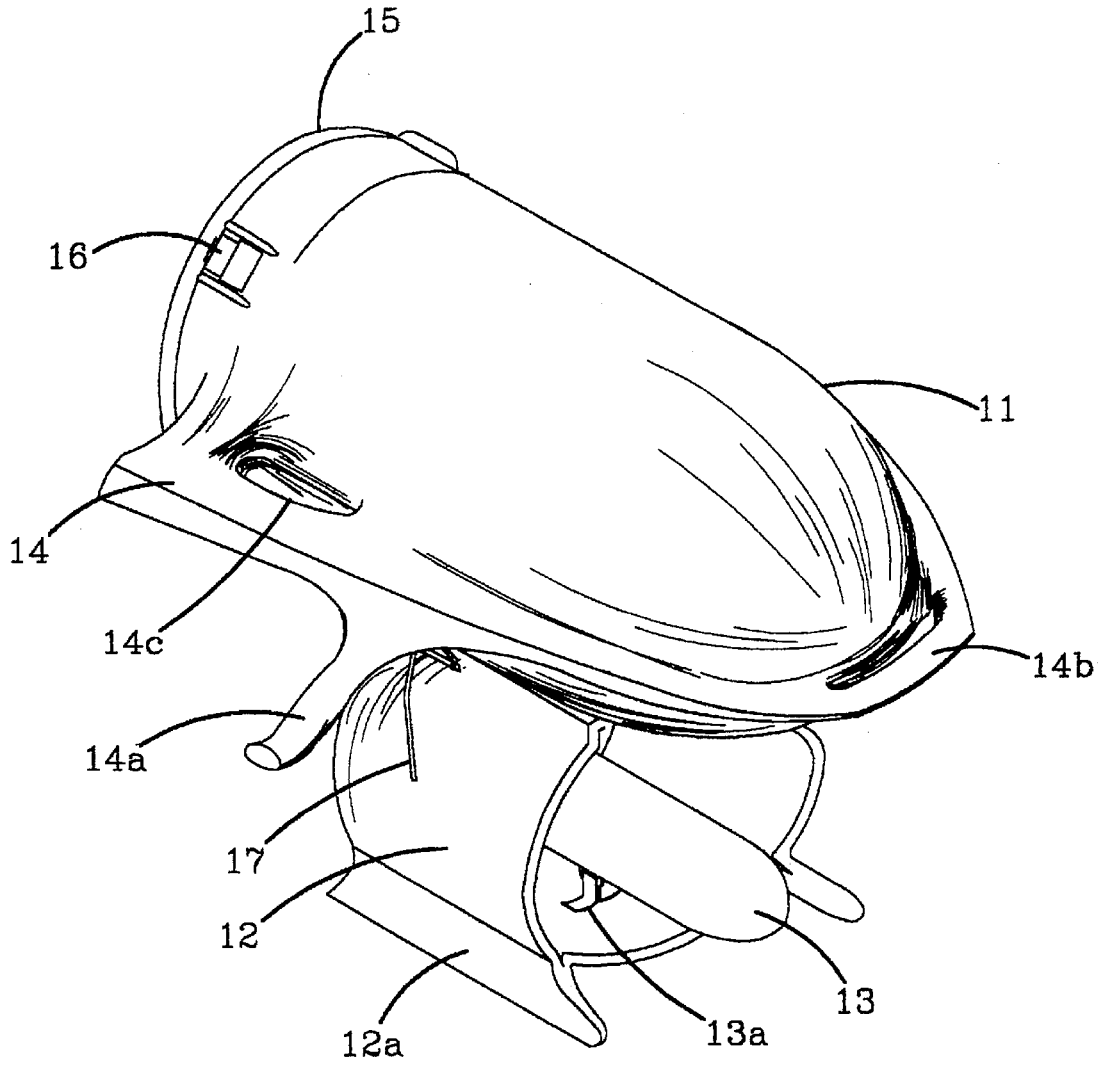
FIG. 1 is a right front perspective view of a preferred embodiment of this invention.
Figure 2:
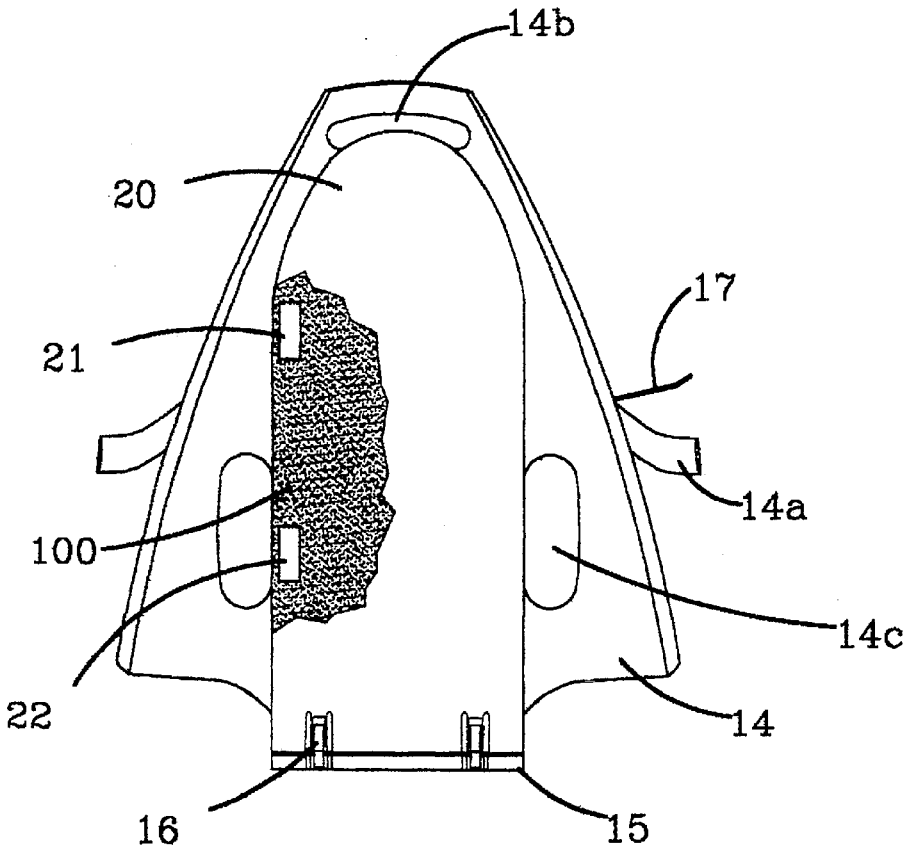
FIG. 2 is a top view.
Figure 3:
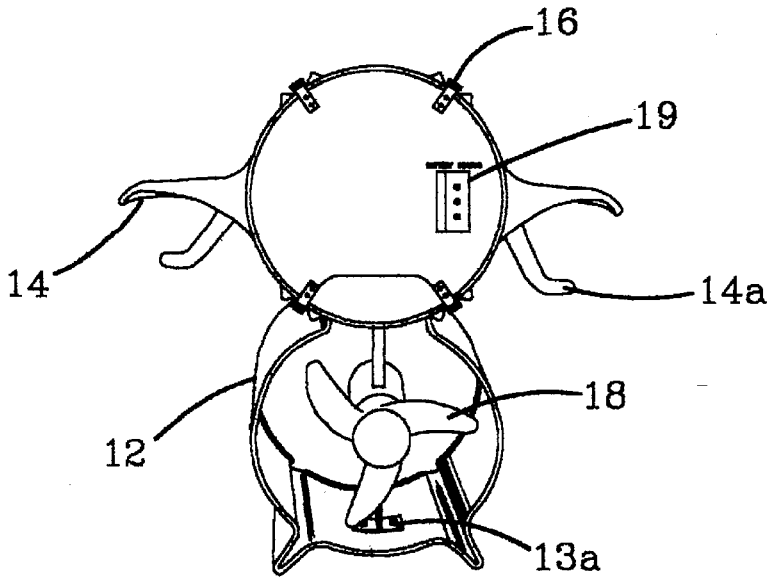
FIG. 3 is a closed back view.
Figure 4:
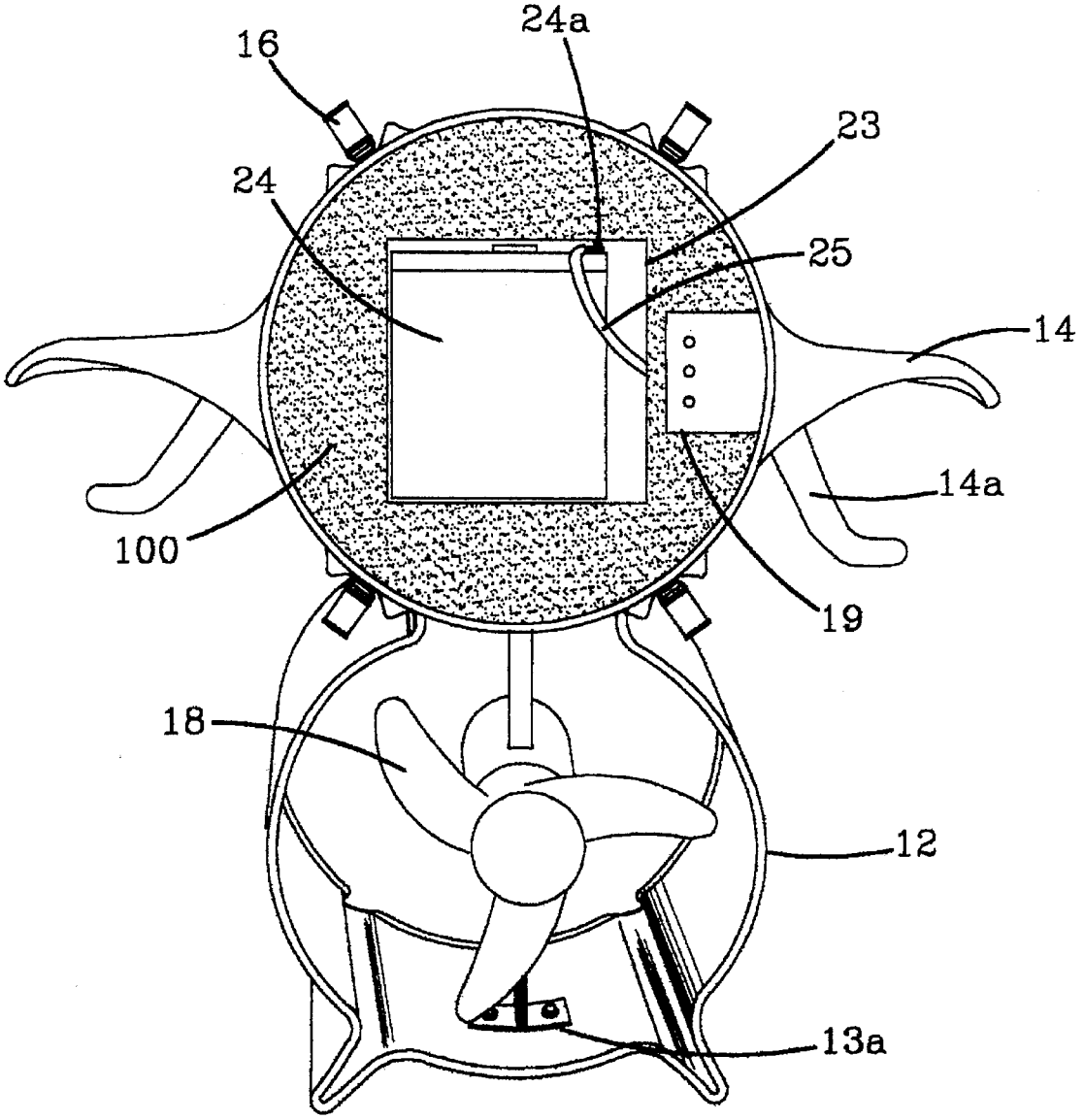
FIG. 4 is an open back view.

Referring now to the drawings, there is illustrated therein a preferred embodiment of this invention.

The elongated, hollow, buoyant, fluid-tight hull 11 is made of a rigid, water-resistant plastic, such as polyethylene. Extending from and integral with the hull are two central, solid, lateral fins 14 which extend back and widen towards the rear. The front end of the fins join and terminate in a carrying handle **14*b*. Extending from approximately the central portion of each fin is a gripping arm 14*a* having an opening 14*c***.

Depending from the hull is a shroud 12 having a bottom support **12*a* and shielding within a trolling (waterproof) motor 13 mounted on a motor bracket 13*a* and connected to a rear propeller 18**.

The back opening of the hull is generally circular and is covered with a transparent back panel 15 removably mounted with clips 16. Spaced within the hull adjacent the back opening is a battery box 23 in which a storage battery 24 is positioned. The battery has terminals **24*a* connected to wires which extend into the hull outside of the battery box and connect to electrical speed control units 21 and 22 spaced apart within the hull. Control units 21 and 22 connect by wiring (not illustrated) to the motor 13 and to magnetic speed control switch and handle 17. The transparent back panel permits viewing of battery power indicator lights 19** connected to the battery.

The entire interior of the hull outside of the battery box is filled with dense, rigid polyurethane, cellular foam which surrounds the control units 21 and 22 and their wiring so as to isolate the battery and its flammable gasses from the embedded control units and wiring. The construction of such control units is within the ordinary skill of persons trained or educated in the electronic arts. A schematic diagram of similar control units is found in my prior Patent, U.S. Pat. No. 5,423,278, particularly FIG. 5.

The casing of the hull, approximately 24" long and 12" wide, is made of approximately ⅜" solid polyethylene by rotation molding. The cover is made of ¾" solid, transparent plastic, as for example polymethylmethacrylate. A foamable polyurethane mixture is fed into the hull, after the battery box is installed, and then the cover tied down on the opening to hold it in place during the foaming for about thirty minutes. A foamable mixture that can be used comprises a mixture of 16 ounces each of a two-component rigid polyurethane foam system of the Stepan Company of Northfield, Illinois to yield a high density foam of about 4-pound density within the hull. The buoyancy was adjusted to neutral by the addition of weights into the hull.

The vehicle can be safely used at depths of over 300 feet, is essentially explosion-proof and substantially leak-proof.

I claim:

1. A personal, submersible, marine vehicle comprising in combination:

(a) a fluid-tight elongated hull having a closed forward end and an open rear end including an accessible battery compartment;

(b) a transverse removable cover for said open rear end;

(c) electrical motor speed control means spaced within said hull;

(d) a shrouded propeller and a motor depending from said hull, said motor having electrical connections with said battery;

(e) a dense, rigid, foam section filling substantially all the air space in said hull which surrounds said battery compartment, said foam section being formed by introducing into said air space a quantity of foamable mixture characterized in that when activated it would normally rise to form a volume larger than said hull volume, closing said open rear end so that during the activation the resultant foam completely fills said air space with said electrical motor speed control means being embedded in said foam section; whereby said foam section shields the potentially flammable gasses of the battery from contact with any source of spark in the electrical control means, and makes the vehicle more resistant to implosion.

2. The personal submersible marine vehicle of claim 1, wherein there is an externally accessible motor speed selection means including magnetic switch means operable on said electrical motor speed control means.

3. The personal submersible marine vehicle of claim 1 wherein said foam section is made of polyurethane foam.

4. The personal submersible marine vehicle of claim 1 wherein said hull is made of solid polyethylene of approximately ⅜" in thickness.

5. The personal submersible marine vehicle of claim 1 wherein extending from and integral with the hull are two central, solid, lateral fins which extend back and widen to the rear and terminate in the front in a carrying handle.

6. The personal submersible marine vehicle of claim 1 wherein a gripping arm extends from each fin.

* * * * *